US011370010B2

(12) United States Patent
White et al.

(10) Patent No.: US 11,370,010 B2
(45) Date of Patent: Jun. 28, 2022

(54) PAINTLESS DENT REMOVAL TOOL, SYSTEM AND METHOD

(71) Applicant: EHC INC., Oklahoma City, OK (US)

(72) Inventors: Chris White, Oklahoma City, OK (US); Jonathan Vandenfontyne, Brussels (BE); Reggie Ayers, Oklahoma City, OK (US); William J Bickel, Jr., Oklahoma City, OK (US)

( * ) Notice: Subject to any disclaimer, the term of this patent is extended or adjusted under 35 U.S.C. 154(b) by 266 days.

(21) Appl. No.: 16/891,497

(22) Filed: Jun. 3, 2020

(65) Prior Publication Data

US 2020/0384519 A1 Dec. 10, 2020

Related U.S. Application Data

(60) Provisional application No. 62/857,719, filed on Jun. 5, 2019.

(51) Int. Cl.
*B21D 1/10* (2006.01)

(52) U.S. Cl.
CPC ..... *B21D 1/10* (2013.01)

(58) Field of Classification Search
CPC . B21D 1/00; B21D 1/06; B21D 1/065; B21D 1/10; B21D 1/12; B23P 6/00; Y10S 72/705
See application file for complete search history.

(56) References Cited

U.S. PATENT DOCUMENTS

| | | | | |
|---|---|---|---|---|
| 1,897,142 A * | 2/1933 | Peterson | B21D 1/12 72/705 |
| 2,539,040 A * | 1/1951 | Sparhawk | B21D 1/06 72/705 |
| 2,602,358 A * | 7/1952 | Lile | B21D 1/10 269/223 |
| 2,676,503 A * | 4/1954 | Back | B21D 1/065 72/409.07 |
| 2,747,643 A * | 5/1956 | Richmond | B21D 1/06 72/237 |
| 5,479,804 A | 1/1996 | Cook | |
| 6,014,885 A | 1/2000 | Griffaton | |
| 6,722,179 B1 | 4/2004 | Ventura | |
| 6,957,561 B1 | 10/2005 | Contreras | |

(Continued)

*Primary Examiner* — Teresa M Ekiert
(74) *Attorney, Agent, or Firm* — D. Ward Hobson

(57) ABSTRACT

A paintless dent removal tool for removing a dent from a vehicle is disclosed. In some embodiments, the paintless dent removal tool includes a stabilizer assembly having a first leg, a second leg and a body therebetween. The body having an opening therethrough, the stabilizer assembly for stabilizing the paintless dent removal tool on a surface of a vehicle. The paintless dent removal tool including a pull bar having a first end and a second end. The first end of the pull bar positioned partially through the opening of the body of the stabilizer assembly and adjustably connected thereto. The paintless dent removal tool including a handle assembly having a first end, a middle portion and a second end. The middle portion of the handle assembly is adjustably connected to the second end of the pull bar. The paintless dent removal tool including a tip member detachably connected to the second end of the handle assembly. The tip member positioned substantially perpendicular to the position of the second end of the handle assembly.

10 Claims, 6 Drawing Sheets

(56) References Cited

U.S. PATENT DOCUMENTS

| | | | |
|---|---|---|---|
| 9,669,442 | B1 | 6/2017 | Alvarez |
| 9,757,782 | B2 | 9/2017 | Wilkinson |
| 9,868,143 | B2 | 1/2018 | Zimmerman |
| 9,889,483 | B1 | 2/2018 | Allen |
| 10,245,629 | B1 | 4/2019 | Skelton et al. |
| 10,252,308 | B2 | 4/2019 | Hummert |

* cited by examiner

PAINTLESS DENT REMOVAL TOOL, SYSTEM AND METHOD

CROSS-REFERENCE TO RELATED APPLICATIONS

This Applications claims priority to U.S. Provisional Application No. 62/857,719, filed on Jun. 5, 2019, which is expressly incorporated herein by reference in its entirety.

FIELD OF INVENTION

The invention is in the technical field of paintless dent repair tools, systems and methods. The invention pertains generally to paintless dent repair tools, systems and methods used to "push-out" a dent in the outer body of a vehicle, such as an automobile, aircraft, motorcycle and the like, for example, and as described and claimed herein.

BACKGROUND

Advancements in construction methods and materials have resulted in lighter and stronger vehicle bodies for automobiles, aircrafts, motorcycles and the like. However, such improved vehicle bodies are often increasingly prone to dents, dings and various other body deformations. Such damage may be caused by, for example, automobile accidents or debris striking the outer surface of the vehicle body. Repairing such dents, dings and deformations can be difficult, laborious and time consuming, even when using traditional paintless dent removal tools and processes.

In general, paintless dent removal is the process of repairing dents to the body of a vehicle body without repainting the vehicle. Thus, saving the owner of the vehicle time and money by avoiding the cost and expense of repainting the vehicle. Traditionally, in paintless dent repair, many repair shops utilize the flexibility and durability of the outer surface of the vehicle body to reach into vehicle body compartments to "push-out" a dent from the inside outward or "pull-out" a dent from the outside of the vehicle body. Once the dent is pushed or pulled out, there is also a need to partially "knock-down" or flatten the dent, so as to smooth-out the outer surface of the vehicle body to completely remove the dent.

Traditionally, repair shops have used a variety of tools to help assist a user with the paintless dent repair process, including tools designed to assist a user with the "push-out" and "pull-out" process and tools designed to assist a user with the "knock-down" process, for example. Unfortunately, however, such traditional tools are inefficiently configured, difficult to use and difficult to control. Thus, decreasing their usefulness and increasing the overall cost of the paintless dent repair process. To that end, it would be advantageous to provide an improved paintless dent removal tool, system and method configured to more efficiently "push-out" dents from the surface of a vehicle body and to guide and stabilize a user's hands during the push-out process so as to increase the effectiveness and reduce the cost of the paintless dent repair process.

SUMMARY OF THE INVENTION

The inventive concepts disclosed herein are generally directed to a paintless dent removal tool for removing a dent from a vehicle. The paintless dent removal tool includes a stabilizer assembly having a first leg, a second leg and a body therebetween. The body having an opening therethrough. The stabilizer assembly for stabilizing the paintless dent removal tool on a surface of a vehicle. The paintless dent removal tool includes a pull bar having a first end and a second end. The first end of the pull bar is positioned partially through the opening of the body of the stabilizer assembly and is adjustably connected thereto. The paintless dent removal tool includes a handle assembly having a first end, a middle portion and a second end. The middle portion of the handle assembly is adjustably connected to the second end of the pull bar. The paintless dent removal tool includes a tip member detachably connected to the second end of the handle assembly. The tip member is positioned substantially perpendicular to the position of the second end of the handle assembly.

In some embodiments, the paintless dent removal tool includes a stabilizer assembly having a first leg, a second leg and a body therebetween. The stabilizer assembly for stabilizing the paintless dent removal tool on a surface of a vehicle. The paintless dent removal tool includes a first pull bar having a first end, a middle portion and a second end. The first end of the first pull bar adjustably connected to the body of the stabilizer assembly. The paintless dent removal tool includes a second pull bar having a first end, a middle portion and a second end. The middle portion of the second pull bar is adjustably connected to the first pull bar. The paintless dent removal tool includes a lever assembly having a rod, a connector, a clamp and a handle. The rod positioned substantially perpendicular to the first pull bar and the second pull bar and having a first end detachably connected to the second pull bar and a second end detachably connected to the connector. The connector detachably connected to the rod and the clamp. The clamp is slide-ably mounted on the first pull bar between the first end and the second end of the first pull bar. The handle is detachably connected to the clamp. The paintless dent removal tool includes a tip member detachably connected to the second end of the second pull bar. The tip member is positioned substantially perpendicular to the position of the second end of the second pull bar. Wherein, the handle of the lever assembly is configured to be pulled upward by a user so that the tip member moves upward between the first leg and the second leg of the stabilizer assembly to push a dent out from underneath the surface of the vehicle.

A method of removing a dent from a vehicle is also disclosed. The method includes the step of providing a paintless dent removal tool for removing a dent from a vehicle. The paintless dent removal tool includes a stabilizer assembly having a first leg, a second leg and a body therebetween. The body having an opening therethrough. The stabilizer assembly for stabilizing the paintless dent removal tool on a surface of a vehicle. The paintless dent removal tool also includes a pull bar having a first end and a second end. The first end of the pull bar is positioned partially through the opening of the body of the stabilizer assembly and adjustably connected thereto. The paintless dent removal tool further includes a handle assembly having a first end, a middle portion and a second end. The middle portion of the handle assembly is adjustably connected to the second end of the pull bar. The paintless dent removal tool further includes a tip member detachably connected to the second end of the handle assembly. The tip member is positioned substantially perpendicular to the position of the second end of the handle assembly. The method of removing a dent from a vehicle includes the step of positioning the stabilizer assembly on the surface of the vehicle. The first leg of the stabilizer assembly and the second leg of the stabilizer assembly are positioned between the dent on the surface of the vehicle. The method of removing a dent from a vehicle further includes the step of positioning the tip member below the surface of the vehicle. The tip member is positioned below the dent and is positioned between the first leg and the second leg of the stabilizer assembly. The method of removing a dent from a vehicle further includes the step of pulling the handle assembly upward by a user, so that the tip member moves upward between the first leg and the second leg of the stabilizer assembly to push a dent out from underneath the surface of the vehicle.

In some embodiments, the method of removing a dent from a vehicle includes the steps of providing a paintless dent removal tool. The paintless dent removal tool includes a stabilizer assembly having a first leg, a second leg and a body therebetween. The stabilizer assembly for stabilizing the paintless dent removal tool on a surface of a vehicle. The paintless dent removal tool includes a first pull bar having a first end, a middle portion and a second end. The first end of the first pull bar adjustably connected to the body of the stabilizer assembly. The paintless dent removal tool includes a second pull bar having a first end, a middle portion and a second end. The middle portion of the second pull bar is adjustably connected to the first pull bar. The paintless dent removal tool includes a lever assembly having a rod, a connector, a clamp and a handle. The rod is positioned substantially perpendicular to the first pull bar and the second pull bar. The rod having a first end detachably connected to the second pull bar and a second end detachably connected to the connector. The connector is detachably connected to the rod and the clamp. The clamp is slide-ably mounted on the first pull bar between the first end and the second end of the first pull bar. The handle is detachably connected to the clamp. The paintless dent removal tool includes a tip member detachably connected to the second end of the second pull bar. The tip member is positioned substantially perpendicular to the position of the second end of the second pull bar. The method further includes the step of positioning the stabilizer assembly on the surface of the vehicle. The first leg of the stabilizer assembly and the second leg of the stabilizer assembly are positioned between the dent on the surface of the vehicle. The method includes the step of positioning the tip member below the surface of the vehicle. The tip member is positioned below the dent and is positioned between the first leg and the second leg of the stabilizer assembly. The method further includes the step of pulling the handle of the lever assembly upward by a user, so that the tip member moves upward between the first leg and the second leg of the stabilizer assembly to push a dent out from underneath the surface of the vehicle.

It is to such an improved paintless dent removal tool and to methods of using thereof that exemplary embodiments of the inventive concepts disclosed and claimed herein are directed.

BRIEF DESCRIPTION OF THE SEVERAL VIEWS OF THE DRAWINGS

Like reference numerals in the figures represent and refer to the same or similar element or function. Implementations of the disclosure may be better understood when consideration is given to the following detailed description thereof. Such description makes reference to the annexed pictorial illustrations, schematics, graphs, drawings, and appendices. In the drawings.

DETAILED DESCRIPTION OF EXEMPLARY EMBODIMENTS

Figure 1:
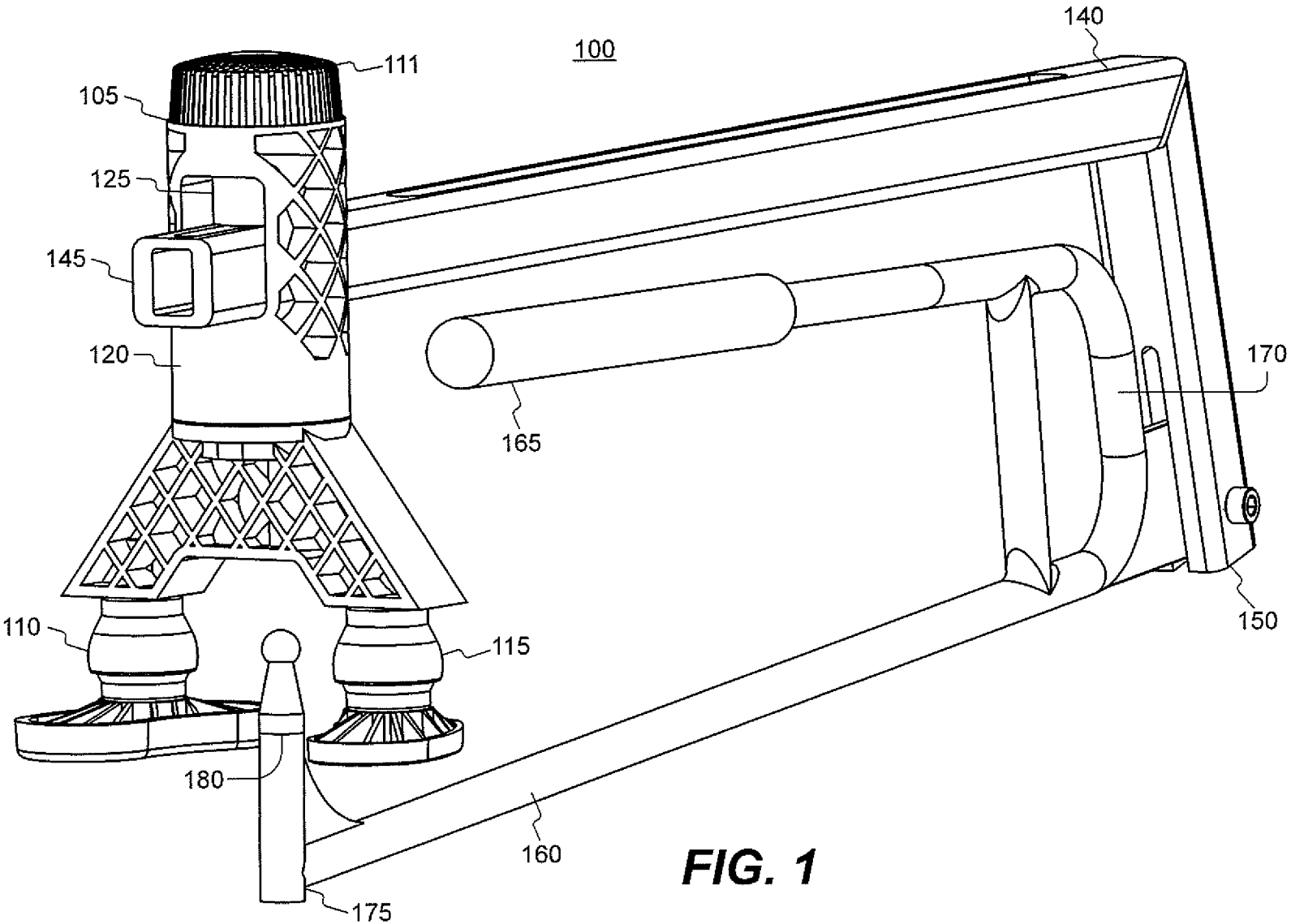
FIG. 1 is a perspective view of the paintless dent removal tool (100) according to the inventive concepts disclosed herein.

Before explaining at least one embodiment of the inventive concepts disclosed herein in detail, it is to be understood that the inventive concepts are not limited in their application to the details of construction and the arrangements of the components or steps or methodologies set forth in the following description or illustrated in the drawings. The inventive concepts disclosed herein are capable of other embodiments or of being practiced or carried out in various ways. Also, it is to be understood that the phraseology and terminology employed herein is for the purpose of description and should not be regarded as limiting the inventive concepts claimed herein in any way.

In the following detailed description of embodiments of the inventive concepts, numerous specific details are set forth in order to provide a more thorough understanding of the inventive concepts. However, it will be apparent to one of ordinary skill in the art that the inventive concepts within the disclosure may be practiced without these specific details. In other instances, well-known features have not been described in detail to avoid unnecessarily complicating the instant disclosure.

As used herein, the terms "comprises," "comprising," "includes," "including," "has," "having," or any other variation thereof, are intended to cover a non-exclusive inclusion. For example, a process, method, article, or apparatus that comprises a list of elements is not necessarily limited to only those elements but may include other elements not expressly listed.

Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concepts. This description should be read to include one or at least one and the singular also includes the plural unless it is obvious that it is meant otherwise.

Finally, as used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Referring now to FIG. 1, shown therein is a perspective view of a paintless dent removal tool (100) for removing a dent from a vehicle. The paintless dent removal tool (100) includes a stabilizer assembly (105) having a first leg (110), a second leg (115) and a body (120) therebetween. The body (120) having an opening (125) therethrough. The stabilizer assembly (105) is for stabilizing the paintless dent removal tool (100) on a surface of a vehicle. The paintless dent removal tool (100) also includes a pull bar (140) having a first end (145) and a second end (150). The first end (145) of the pull bar (140) is positioned partially through the opening (125) of the body (120) of the stabilizer assembly (105) and is adjustably connected thereto. The paintless dent removal tool (100) further includes a handle assembly (160) having a first end (165), a middle portion (170) and a second end (175). The middle portion (170) of the handle assembly (160) is adjustably connected to the second end (150) of the pull bar (140). The paintless dent removal tool (100) further includes a tip member (180) detachably connected to the second end (175) of the handle assembly (160). The tip member (180) is positioned substantially perpendicular to the position of the second end (175) of the handle assembly (160). Wherein the first end (165) of the handle assembly (160) is configured to be pulled upward by a user so that the tip member (180) moves upward between the first leg (110) and the second leg (115) of the stabilizer assembly (105) to push a dent out from underneath the surface of the vehicle.

The paintless dent removal tool (100) may be constructed from any material sufficiently rigid to maintain the structural integrity of the paintless dent removal tool (100) when in use. For example, the paintless dent removal tool (100) may be constructed from metals, alloys, steel, titanium, non-metals, carbon fiber, plastics, polymers, resins, ceramics, composite materials, combinations thereof and the like.

The paintless dent removal tool (100) is shown as having a substantially rectangular shape. However, it should be understood that the paintless dent removal tool (100) may have any desired shape, including but not limited to, a generally circular, square, triangular or any other desired shape sufficient to permit the paintless dent removal tool (100) to be used as described and claimed herein.

The stabilizer assembly (105) has a first leg (110), a second leg (115) and a body (120) therebetween. The body (120) has an opening (125) therethrough. The stabilizing assembly (105) is for stabilizing the paintless dent removal tool (100) on a surface of a vehicle. The stabilizer assembly (105) may be constructed from any material sufficiently rigid to maintain the structural integrity of the paintless dent removal tool (100) when in use. For example, the stabilizer assembly (105) may be constructed from metals, alloys, steel, titanium, non-metals, carbon fiber, plastics, polymers, resins, ceramics, composite materials, combinations thereof and the like.

The stabilizer assembly (105) is shown as having a substantially "Y" shape. However, it should be understood that the stabilizer assembly (105) may have any desired shape, including but not limited to, a generally circular, square, triangular or any other desired shape sufficient to permit the paintless dent removal tool (100) to be used as described and claimed herein.

The first leg (110) and the second leg (115) of the paintless dent removal tool (100) are both configured to be placed on the outer surface of a vehicle to control vibration and improve the accuracy of the paintless dent removal tool (100). The first leg (110) and the second leg (115) may be constructed from any material sufficiently rigid to maintain the structural integrity of the paintless dent removal tool (100) when in use. For example, the first leg (110) and the second leg (115) may be constructed from metals, alloys, steel, titanium, non-metals, carbon fiber, plastics, polymers, resins, ceramics, composite materials, combinations thereof and the like.

The first leg (110) and second leg (115) are shown as having a substantially circular or square shape. However, it should be understood that the first leg (110) and the second leg (115) may have any desired shape, including but not limited to, a generally rectangular, triangular or any other desired shape sufficient to permit the first leg (110) and the second leg (115) to be used as described and claimed herein. In some embodiments, the first leg (110) and the second leg (115) include a rubber cap configured to grip or secure the first leg (110) and the second leg (115) to the vehicle body when in use and to prevent slippage. The first leg (110) and the second leg (115) configured to control vibration of the vehicle body surface when the paintless dent removal tool (100) is used to remove a dent from a vehicle.

The body (120) of the stabilizer assembly (105) may be constructed from any material sufficiently rigid to maintain the structural integrity of the paintless dent removal tool (100) when in use. For example, the body (120) may be constructed from metals, alloys, steel, titanium, non-metals, carbon fiber, plastics, polymers, resins, ceramics, composite materials, combinations thereof and the like.

Figure 3:
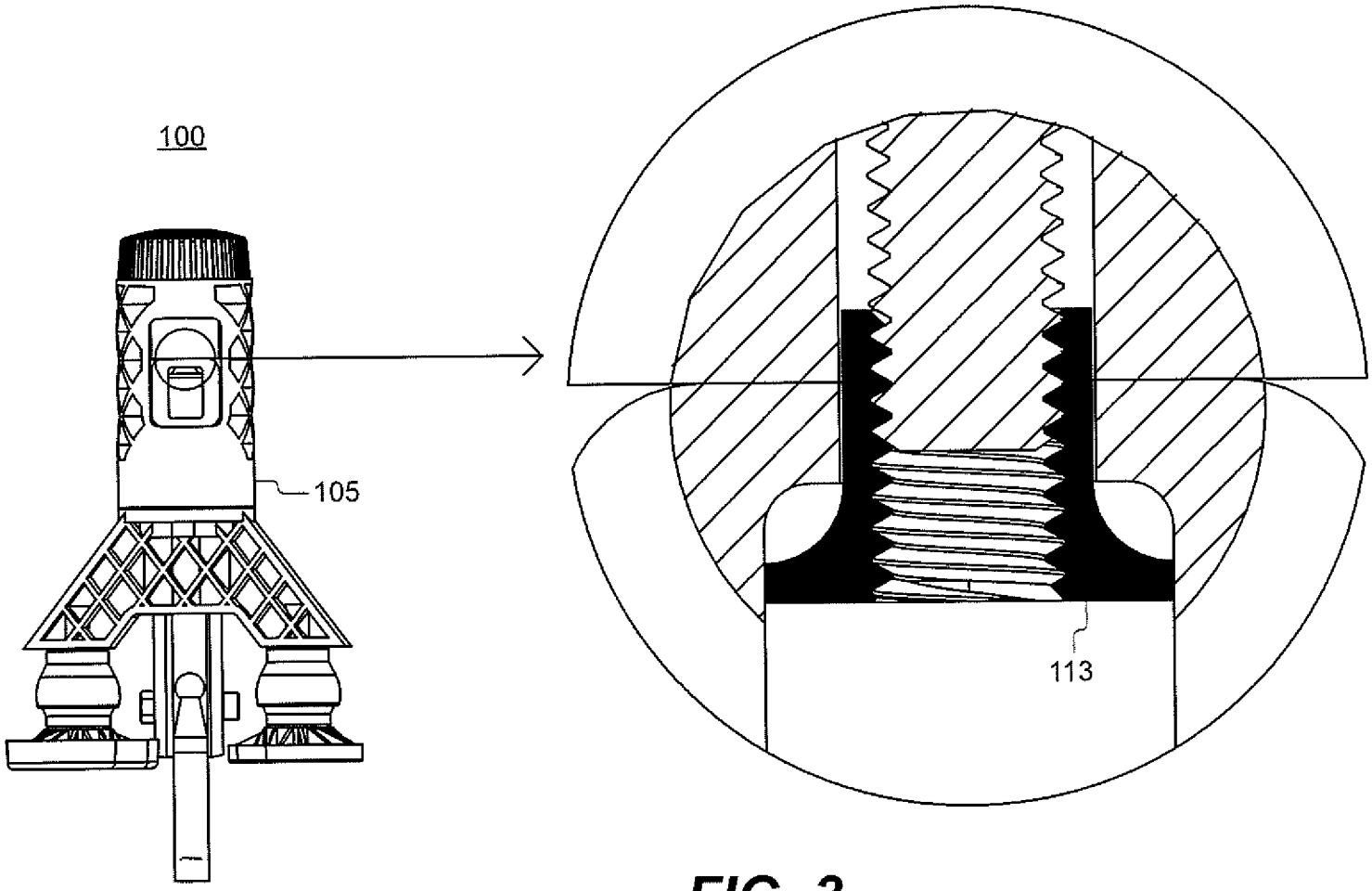
FIG. 3 is an exploded view of a connector assembly of the paintless dent removal tool (100) according to the inventive concepts disclosed herein.

The body (120) includes an opening (125) therethrough. The opening (125) is sized and configured to accept and secure the first end (145) of the pull bar (140) thereto. As shown in FIG. 3, the pull bar (140) is secured through the opening (125) by means of an adjustable threaded bolt and nut assembly. It should be understood however, that any means of adjustably securing the pull bar (140) through the opening (125) may be used. For example, a pin, screw, clasp or other adjustable connector assemblies known to one of ordinary skill in the art. Further, the body (120) may, in some embodiments, have a cap (111) positioned on a top portion of the body (120). The cap (111) may be adjusted, turned clockwise or counterclockwise, for example, to tighten or loosen the threaded bolt and nut assembly, such as the adjustable connector assembly (113) shown in FIG. 3. The adjustable connector assembly may be a threaded bolt and nut assembly or any other means of adjustably securing the pull bar (140) through the opening (125). For example, a pin, screw, clasp or other adjustable connector assemblies known to one of ordinary skill in the art.

While the opening (125) is shown and generally described as being rectangular, it should be readily understood by one of ordinary skill in the art that the opening (125) may, alternatively, be configured in a variety of shapes and sizes sufficient to fit a particular shape and size of the first end (145) of the pull bar (140). For example, the opening (125) may be square, triangular, circular or any other shape sufficient to carry out the inventive concepts described herein. Further, the opening (125) may be formed in a variety of sizes, so long as the opening is shaped and sized to sufficiently connect to the first end (145) of the pull bar (140) in accordance with the inventive concepts disclosed herein.

The pull bar (140) has a first end (145) and a second end (150). The first end (145) of the pull bar (140) positioned partially through the opening (125) of the body (120) of the stabilizer assembly (105) and is adjustably connected thereto. The pull bar (140) may be constructed from any material sufficiently rigid to maintain the structural integrity of the paintless dent removal tool (100) when in use. For example, the pull bar (140) may be constructed from metals, alloys, steel, titanium, non-metals, carbon fiber, plastics, polymers, resins, ceramics, composite materials, combinations thereof and the like. The pull bar (140) is shown as having a substantially "L" shape. However, it should be understood that the pull bar (140) may have any desired shape, including but not limited to, a generally curved, straight, circular, square, triangular or any other desired shape sufficient to permit the paintless dent removal tool (100) to be used as described and claimed herein.

The handle assembly (160) has a first end (165), a middle portion (170) and a second end (175). The middle portion (170) of the handle assembly (160) is adjustably connected to the second end (150) of the pull bar (140). The handle assembly (160) may be constructed from any material sufficiently rigid to maintain the structural integrity of the paintless dent removal tool (100) when in use. For example, the handle assembly (160) may be constructed from metals, alloys, steel, titanium, non-metals, carbon fiber, plastics, polymers, resins, ceramics, composite materials, combinations thereof and the like. The handle assembly (160) is shown as having a substantially "U" shape. However, it should be understood that the handle assembly (160) may have any desired shape, including but not limited to, a generally curved, straight, circular, square, triangular or any other desired shape sufficient to permit the paintless dent removal tool (100) to be used as described and claimed herein.

The tip member (180) is detachably connected to the second end (175) of the handle assembly (160). The tip member (180) is positioned substantially perpendicular to the position of the second end (175) of the handle assembly (160). In use, the tip member (180) pushes upward on the dent to "push" the dent out from below the surface of the vehicle. The tip member (180) may be constructed from any material sufficiently rigid to maintain the structural integrity of the paintless dent removal tool (100) when in use.

For example, the tip member (180) may be constructed from metals, alloys, steel, titanium, non-metals, carbon fiber, plastics, polymers, resins, ceramics, composite materials, combinations thereof and the like. The tip member (180) may have any desired shape, including but not limited to, a generally curved, straight, circular, square, triangular or any other desired shape sufficient to permit the paintless dent removal tool (100) to be used as described and claimed herein.

In some embodiments, the tip member (180) further includes one or more removable cap. Each cap configured to be of a different shape, size and material, so as to permit a user to use different caps to fit different sized or positioned dents or to be used with different types of vehicle surfaces. For example, a small square cap may be used for a small dent, while a larger rectangular cap may be used for a larger dent. Further, a cap may be formed from rubber or the like so as to reduce any scratching to the vehicle surface, while some caps may be formed from a harder material such as plastic or metal, for example.

Figure 2:
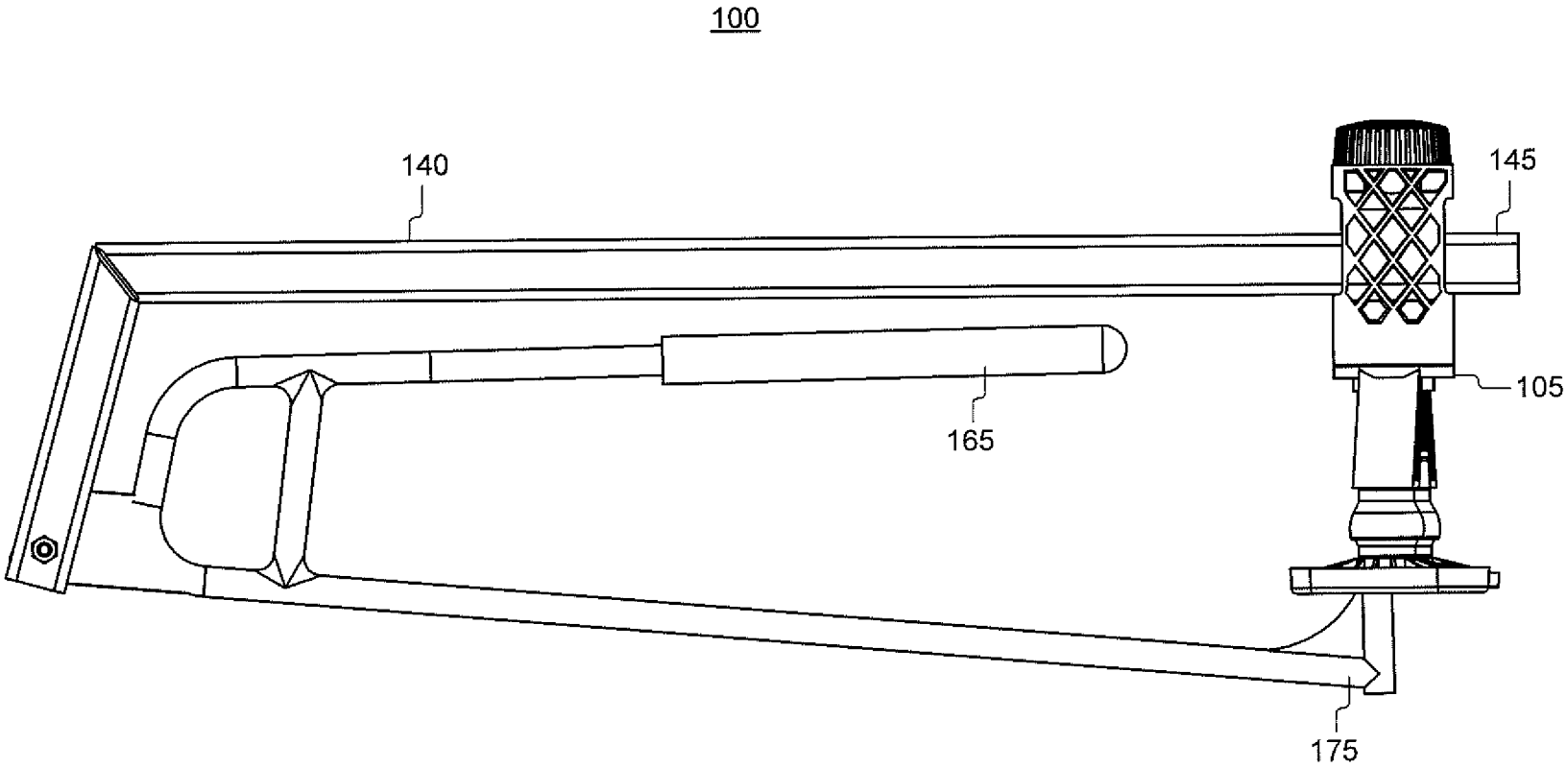
FIG. 2 is a side view of the paintless dent removal tool (100) according to the inventive concepts disclosed herein.

Referring now to FIG. 2, shown therein is side view of a paintless dent removal tool (100) for removing a dent from a vehicle. The paintless dent removal tool (100) includes a stabilizer assembly (105) having a first leg (110), a second leg (115) and a body (120) therebetween. The body (120) having an opening (125) therethrough. The stabilizer assembly (105) is for stabilizing the paintless dent removal tool (100) on a surface of a vehicle. The paintless dent removal tool (100) includes a pull bar (140) having a first end (145) and a second end (150). The first end (145) of the pull bar (140) is positioned partially through the opening (125) of the body (120) of the stabilizer assembly (105) and is adjustably connected thereto. The paintless dent removal tool (100) includes a handle assembly (160) having a first end (165), a middle portion (170) and a second end (175). The middle portion (170) of the handle assembly (160) is adjustably connected to the second end (150) of the pull bar (140). The paintless dent removal tool (100) includes a tip member (180) detachably connected to the second end (175) of the handle assembly (160). The tip member (180) is positioned substantially perpendicular to the position of the second end (175) of the handle assembly (160). Wherein the first end (165) of the handle assembly (160) is configured to be pulled upward by a user so that the tip member (180) moves upward between the first leg (110) and the second leg (115) of the stabilizer assembly (105) to push a dent out from underneath the surface of the vehicle.

The paintless dent removal tool (100) may be constructed from any material sufficiently rigid to maintain the structural integrity of the paintless dent removal tool (100) when in use. For example, the paintless dent removal tool (100) may be constructed from metals, alloys, steel, titanium, non-metals, carbon fiber, plastics, polymers, resins, ceramics, composite materials, combinations thereof and the like.

The paintless dent removal tool (100) is shown as having a substantially rectangular shape. However, it should be understood that the paintless dent removal tool (100) may have any desired shape, including but not limited to, a generally circular, square, triangular or any other desired shape sufficient to permit the paintless dent removal tool (100) to be used as described and claimed herein.

The stabilizer assembly (105) has a first leg (110), a second leg (115) and a body (120) therebetween. The body (120) has an opening (125) therethrough. The stabilizing assembly (105) is for stabilizing the paintless dent removal tool (100) on a surface of a vehicle. The stabilizer assembly (105) may be constructed from any material sufficiently rigid to maintain the structural integrity of the paintless dent removal tool (100) when in use. For example, the stabilizer assembly (105) may be constructed from metals, alloys, steel, titanium, non-metals, carbon fiber, plastics, polymers, resins, ceramics, composite materials, combinations thereof and the like.

The stabilizer assembly (105) is shown as having a substantially "Y" shape. However, it should be understood that the stabilizer assembly (105) may have any desired shape, including but not limited to, a generally circular, square, triangular or any other desired shape sufficient to permit the paintless dent removal tool (100) to be used as described and claimed herein.

The first leg (110) and the second leg (115) of the paintless dent removal tool (100) are both configured to be placed on the outer surface of a vehicle to control vibration and improve the accuracy of the paintless dent removal tool (100). The first leg (110) and the second leg (115) may be constructed from any material sufficiently rigid to maintain the structural integrity of the paintless dent removal tool (100) when in use. For example, the first leg (110) and the second leg (115) may be constructed from metals, alloys, steel, titanium, non-metals, carbon fiber, plastics, polymers, resins, ceramics, composite materials, combinations thereof and the like.

The first leg (110) and second leg (115) are shown as having a substantially circular or square shape. However, it should be understood that the first leg (110) and the second leg (115) may have any desired shape, including but not limited to, a generally rectangular, triangular or any other desired shape sufficient to permit the first leg (110) and the second leg (115) to be used as described and claimed herein. In some embodiments, the first leg (110) and the second leg (115) include a rubber cap configured to grip or secure the first leg (110) and the second leg (115) to the vehicle body when in use and to prevent slippage. The first leg (110) and the second leg (115) configured to control vibration of the vehicle body surface when the paintless dent removal tool (100) is used to remove a dent from a vehicle.

The body (120) of the stabilizer assembly (105) may be constructed from any material sufficiently rigid to maintain the structural integrity of the paintless dent removal tool (100) when in use. For example, the body (120) may be constructed from metals, alloys, steel, titanium, non-metals, carbon fiber, plastics, polymers, resins, ceramics, composite materials, combinations thereof and the like.

The body (120) includes an opening (125) therethrough. The opening (125) is sized and configured to accept and secure the first end (145) of the pull bar (140) thereto. As shown in FIG. 3, the pull bar (140) is secured through the opening (125) by means of an adjustable threaded bolt and nut assembly. It should be understood however, that any means of adjustably securing the pull bar (140) through the opening (125) may be used. For example, a pin, screw, clasp or other adjustable connector assemblies known to one of ordinary skill in the art. Further, the body (120) may, in some embodiments, have a cap (111) positioned on a top portion of the body (120). The cap (111) may be adjusted, turned clockwise or counterclockwise, for example, to tighten or loosen the threaded bolt and nut assembly, such as the adjustable connector assembly (113) shown in FIG. 3. The adjustable connector assembly may be a threaded bolt and nut assembly or any other means of adjustably securing the pull bar (140) through the opening (125). For example, a pin, screw, clasp or other adjustable connector assemblies known to one of ordinary skill in the art.

While the opening (125) is shown and generally described as being rectangular, it should be readily understood by one of ordinary skill in the art that the opening (125) may, alternatively, be configured in a variety of shapes and sizes sufficient to fit a particular shape and size of the first end (145) of the pull bar (140). For example, the opening (125) may be square, triangular, circular or any other shape sufficient to carry out the inventive concepts described herein. Further, the opening (125) may be formed in a variety of sizes, so long as the opening is shaped and sized to sufficiently connect to the first end (145) of the pull bar (140) in accordance with the inventive concepts disclosed herein.

The pull bar (140) has a first end (145) and a second end (150). The first end (145) of the pull bar (140) positioned partially through the opening (125) of the body (120) of the stabilizer assembly (105) and is adjustably connected thereto. The pull bar (140) may be constructed from any material sufficiently rigid to maintain the structural integrity of the paintless dent removal tool (100) when in use. For example, the pull bar (140) may be constructed from metals, alloys, steel, titanium, non-metals, carbon fiber, plastics, polymers, resins, ceramics, composite materials, combinations thereof and the like. The pull bar (140) is shown as having a substantially "L" shape. However, it should be understood that the pull bar (140) may have any desired shape, including but not limited to, a generally curved, straight, circular, square, triangular or any other desired shape sufficient to permit the paintless dent removal tool (100) to be used as described and claimed herein.

The handle assembly (160) has a first end (165), a middle portion (170) and a second end (175). The middle portion (170) of the handle assembly (160) is adjustably connected to the second end (150) of the pull bar (140). The handle assembly (160) may be constructed from any material sufficiently rigid to maintain the structural integrity of the paintless dent removal tool (100) when in use. For example, the handle assembly (160) may be constructed from metals, alloys, steel, titanium, non-metals, carbon fiber, plastics, polymers, resins, ceramics, composite materials, combinations thereof and the like. The handle assembly (160) is shown as having a substantially "U" shape. However, it should be understood that the handle assembly (160) may have any desired shape, including but not limited to, a generally curved, straight, circular, square, triangular or any other desired shape sufficient to permit the paintless dent removal tool (100) to be used as described and claimed herein.

The tip member (180) is detachably connected to the second end (175) of the handle assembly (160). The tip member (180) is positioned substantially perpendicular to the position of the second end (175) of the handle assembly (160). In use, the tip member (180) pushes upward on the dent to "push" the dent out from below the surface of the vehicle. The tip member (180) may be constructed from any material sufficiently rigid to maintain the structural integrity of the paintless dent removal tool (100) when in use.

For example, the tip member (180) may be constructed from metals, alloys, steel, titanium, non-metals, carbon fiber, plastics, polymers, resins, ceramics, composite materials, combinations thereof and the like. The tip member (180) may have any desired shape, including but not limited to, a generally curved, straight, circular, square, triangular or any other desired shape sufficient to permit the paintless dent removal tool (100) to be used as described and claimed herein.

In some embodiments, the tip member (180) further includes one or more removable cap. Each cap configured to be of a different shape, size and material, so as to permit a user to use different caps to fit different sized or positioned dents or to be used with different types of vehicle surfaces. For example, a small square cap may be used for a small dent, while a larger rectangular cap may be used for a larger dent. Further, a cap may be formed from rubber or the like so as to reduce any scratching to the vehicle surface, while some caps may be formed from a harder material such as plastic or metal, for example.

Referring now to FIG. 3, shown therein is an exploded view of a connector assembly (113) of the paintless dent removal tool (100). In use, the pull bar (140) is secured through the opening (125) by means of an adjustable connector assembly (113). The cap (111) may be adjusted, turned clockwise or counterclockwise, for example, to tighten or loosen the adjustable connector assembly (113). The adjustable connector assembly may be a threaded bolt and nut assembly or any other means of adjustably securing the pull bar (140) through the opening (125). For example, a pin, screw, clasp or other adjustable connector assemblies known to one of ordinary skill in the art.

Figure 4:
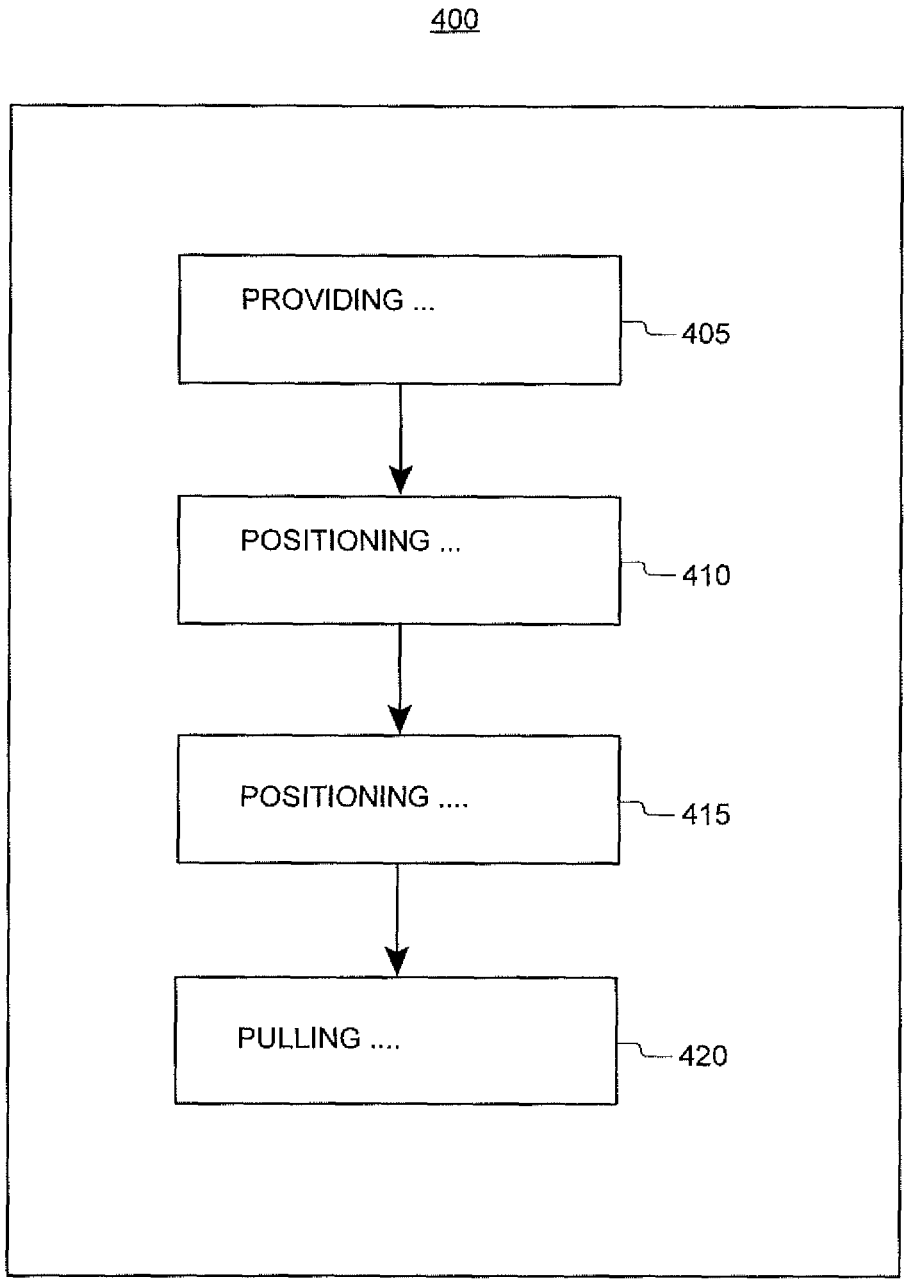
FIG. 4 is a diagram of a method (400) of removing a dent from a vehicle, according to the inventive concepts disclosed herein.

Referring now to FIG. 4, shown therein is a diagram of a method (400) of removing a dent from a vehicle. The method (400) includes the step of providing (405) a paintless dent removal tool (100) for removing a dent from a vehicle. The paintless dent removal tool (100) includes a stabilizer assembly (105) having a first leg (110), a second leg (115) and a body (120) therebetween. The body (120) having an opening (125) therethrough. The stabilizer assembly (105) for stabilizing the paintless dent removal tool (100) on a surface of a vehicle. The paintless dent removal tool (100)

includes a pull bar (140) having a first end (145) and a second end (150). The first end (145) of the pull bar (140) is positioned partially through the opening (125) of the body (120) of the stabilizer assembly (105) and is adjustably connected thereto. The paintless dent removal tool (100) includes a handle assembly (160) having a first end (165), a middle portion (170) and a second end (175). The middle portion (170) of the handle assembly (160) is adjustably connected to the second end (175) of the pull bar (140). The paintless dent removal tool (100) includes a tip member (180) detachably connected to the second end (175) of the handle assembly (160). The tip member (180) is positioned substantially perpendicular to the position of the second end (175) of the handle assembly (160).

The method (400) of removing a dent from a vehicle further includes the step of positioning (410) the stabilizer assembly (105) on the surface of the vehicle. The first leg (110) of the stabilizer assembly (105) and the second leg (115) of the stabilizer assembly (105) positioned between the dent on the surface of the vehicle.

The method (400) of removing a dent from a vehicle further includes the step of positioning (415) the tip member (180) below the surface of the vehicle. The tip member (180) is positioned below the dent and is positioned between the first leg (110) and the second leg (115) of the stabilizer assembly (105).

The method (400) of removing a dent from a vehicle includes the step of pulling (420) the handle assembly (160) upward by a user, so that the tip member (180) moves upward between the first leg (110) and the second leg (115) of the stabilizer assembly (105) to push a dent out from underneath the surface of the vehicle.

Figure 5:
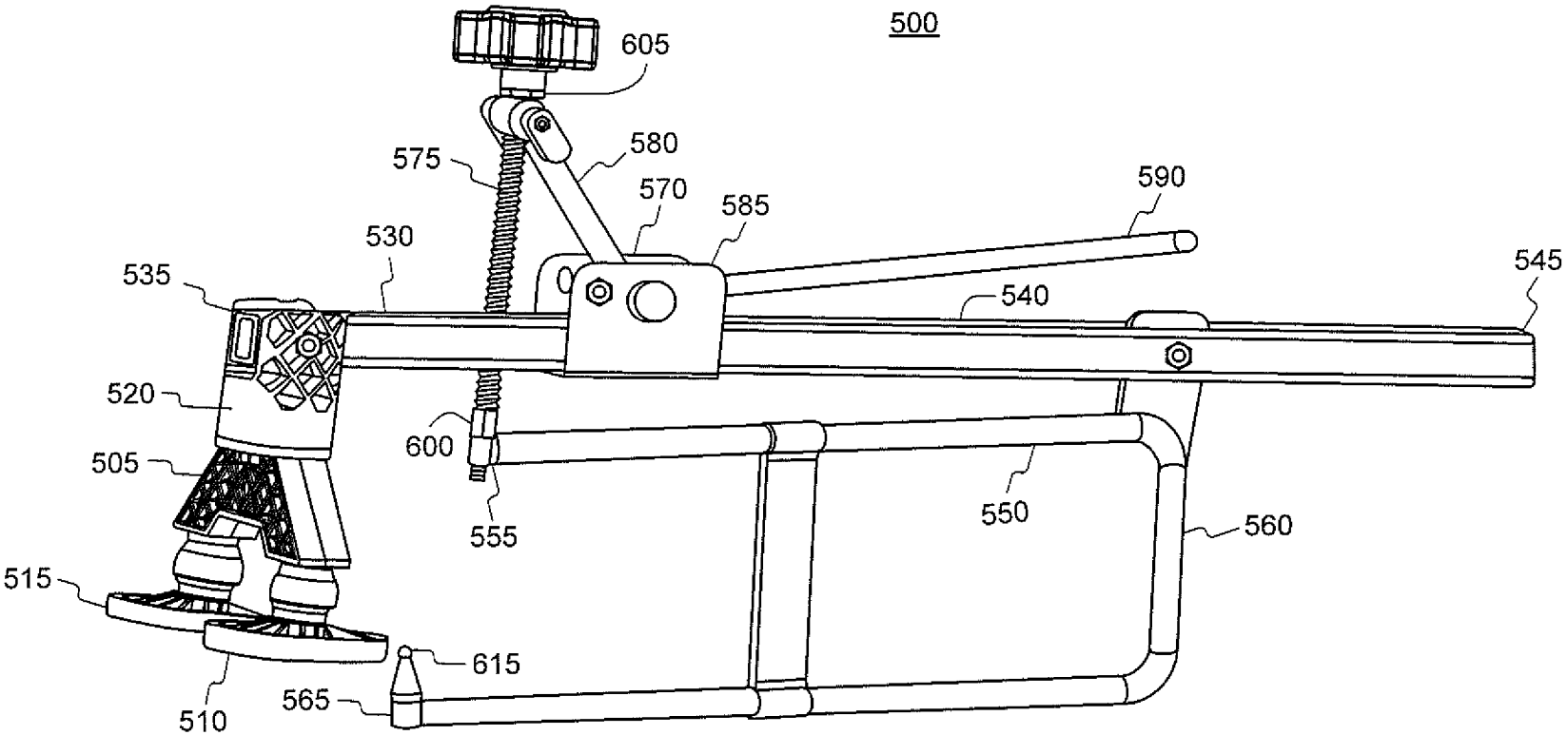
FIG. 5 is a perspective view of a paintless dent removal tool (500) in accordance with the inventive concepts disclosed herein.

Referring now to FIG. 5, shown therein is a perspective view of a paintless dent removal tool (500) in accordance with the inventive concepts disclosed herein. The paintless dent removal tool (500) for removing a dent from a vehicle. The paintless dent removal tool (500) including a stabilizer assembly (505) having a first leg (510), a second leg (515) and a body (520) therebetween. The stabilizer assembly (505) for stabilizing the paintless dent removal tool (500) on a surface of a vehicle. The paintless dent removal tool (500) includes a first pull bar (530) having a first end (535), a middle portion (540) and a second end (545). The first end (535) of the first pull bar (530) adjustably connected to the body (520) of the stabilizer assembly (505). The paintless dent removal tool (500) includes a second pull bar (550) having a first end (555), a middle portion (560) and a second end (565). The middle portion (560) of the second pull bar (550) is adjustably connected to the first pull bar (530). The paintless dent removal tool (500) includes a lever assembly (570) having a rod (575), a connector (580), a clamp (585) and a handle (590). The rod (575) is positioned substantially perpendicular to the first pull bar (530) and the second pull bar (550). The rod (575) includes a first end (600) detachably connected to the second pull bar (550) and a second end (605) detachably connected to the connector (580). The connector (580) is detachably connected to the rod (575) and the clamp (585). The clamp (585) is slide-ably mounted on the first pull bar (530) between the first end (535) and the second end (545) of the first pull bar (530). The handle (590) is detachably connected to the clamp (585). The paintless dent removal tool (500) includes a tip member (615) detachably connected to the second end (565) of the second pull bar (550). The tip member (615) is positioned substantially perpendicular to the position of the second end (565) of the second pull bar (550). Wherein, the handle (590) of the lever assembly (570) is configured to be pulled upward by a user so that the tip member (615) moves upward between the first leg (510) and the second leg (515) of the stabilizer assembly (505) to push a dent out from underneath the surface of the vehicle.

In some embodiments of the paintless dent removal tool (500), the stabilizer assembly (505) is substantially Y-shaped. While in some embodiments of the paintless dent removal tool (500), the first pull bar (530) is substantially L-shaped. Further, in some embodiments of the paintless dent removal tool (500), the second pull bar (550) is substantially U-shaped.

The paintless dent removal tool (500) may be constructed from any material sufficiently rigid to maintain the structural integrity of the paintless dent removal tool (500) when in use. For example, the paintless dent removal tool (500) may be constructed from metals, alloys, steel, titanium, non-metals, carbon fiber, plastics, polymers, resins, ceramics, composite materials, combinations thereof and the like.

The paintless dent removal tool (500) is shown as having a substantially rectangular shape. However, it should be understood that the paintless dent removal tool (500) may have any desired shape, including but not limited to, a generally circular, square, triangular or any other desired shape sufficient to permit the paintless dent removal tool (500) to be used as described and claimed herein.

The stabilizer assembly (505) has a first leg (510), a second leg (515) and a body (520) therebetween. The stabilizer assembly (505) for stabilizing the paintless dent removal tool (500) on a surface of a vehicle. The stabilizer assembly (505) may be constructed from any material sufficiently rigid to maintain the structural integrity of the paintless dent removal tool (500) when in use. For example, the stabilizer assembly (505) may be constructed from metals, alloys, steel, titanium, non-metals, carbon fiber, plastics, polymers, resins, ceramics, composite materials, combinations thereof and the like.

The stabilizer assembly (505) is shown as having a substantially "Y" shape. However, it should be understood that the stabilizer assembly (505) may have any desired shape, including but not limited to, a generally circular, square, triangular or any other desired shape sufficient to permit the paintless dent removal tool (500) to be used as described and claimed herein.

The first leg (510) and the second leg (515) of the paintless dent removal tool (500) are both configured to be placed on the outer surface of a vehicle to control vibration and improve the accuracy of the paintless dent removal tool (500). The first leg (510) and the second leg (515) may be constructed from any material sufficiently rigid to maintain the structural integrity of the paintless dent removal tool (500) when in use. For example, the first leg (510) and the second leg (515) may be constructed from metals, alloys, steel, titanium, non-metals, carbon fiber, plastics, polymers, resins, ceramics, composite materials, combinations thereof and the like.

The first leg (510) and the second leg (515) are shown as having a substantially circular or square shape. However, it should be understood that the first leg (510) and the second leg (515) may have any desired shape, including but not limited to, a generally rectangular, triangular or any other desired shape sufficient to permit the first leg (510) and the second leg (515) to be used as described and claimed herein. In some embodiments, the first leg (510) and the second leg (515) each include a rubber cap affixed thereto and configured to grip or secure the first leg (510) and the second leg (515) to the vehicle body when in use and to prevent slippage. The first leg (510) and the second leg (515) are configured to control vibration of the vehicle body surface when the paintless dent removal tool (500) is used to remove a dent from a vehicle.

The body (520) of the stabilizer assembly (505) may be constructed from any material sufficiently rigid to maintain the structural integrity of the paintless dent removal tool (500) when in use. For example, the body (520) may be constructed from metals, alloys, steel, titanium, non-metals, carbon fiber, plastics, polymers, resins, ceramics, composite materials, combinations thereof and the like. As shown in FIG. 5, the first pull bar (530) is secured to the body (520) by means of an adjustable threaded bolt and nut assembly. It should be understood however, that any means of securing the first pull bar (530) to the body (520) may be used. For example, a pin, screw, clasp, weld, joint, or other connector assembly known to one of ordinary skill in the art.

The first pull bar (530) has a first end (535), a middle portion (540) and a second end (545), the first end (535) of the first pull bar (530) adjustably connected to the body (520) of the stabilizer assembly (505). The first pull bar (530) may be constructed from any material sufficiently rigid to maintain the structural integrity of the paintless dent removal tool (500) when in use. For example, the first pull bar (530) may be constructed from metals, alloys, steel, titanium, non-metals, carbon fiber, plastics, polymers, resins, ceramics, composite materials, combinations thereof and the like. The first pull bar (530) is shown as having a substantially linear shape. However, it should be understood that the first pull bar (530) may have any desired shape, including but not limited to a generally curved, "L", straight, circular, triangular or any other desired shape sufficient to permit the paintless dent removal tool (500) to be used as described and claimed herein.

The second pull bar (550) has a first end (555), a middle portion (560) and a second end (565). The middle portion (560) of the second pull bar (550) is adjustably connected to the first pull bar (530). The second pull bar (550) may be constructed from any material sufficiently rigid to maintain the structural integrity of the paintless dent removal tool (500) when in use. For example, the second pull bar (550) may be constructed from metals, alloys, steel, titanium, non-metals, carbon fiber, plastics, polymers, resins, ceramics, composite materials, combinations thereof and the like. The second pull bar (550) is shown as having a substantially U shape. However, it should be understood that the second pull bar (550) may have any desired shape, including but not limited to a generally straight, circular, triangular or any other desired shape sufficient to permit the paintless dent removal tool (500) to be used as described and claimed herein.

The lever assembly (570) includes a rod (575), a connector (580), a clamp (585) and a handle (590). The rod (575) is positioned substantially perpendicular to the first pull bar (530) and the second pull bar (550). The rod (575) includes a first end (600) detachably connected to the second pull bar (550) and a second end (605) detachably connected to the connector (580). The connector (580) is detachably connected to the rod (575) and the clamp (585). The clamp (585) is slide-ably mounted on the first pull bar (530) between the first end (535) and the second end (545) of the first pull bar (530). The handle (590) is detachably connected to the clamp (585).

The lever assembly (570) may be constructed from any material sufficiently rigid to maintain the structural integrity of the paintless dent removal tool (500) when in use. For example, the lever assembly (570) may be constructed from metals, alloys, steel, titanium, non-metals, carbon fiber, plastics, polymers, resins, ceramics, composite materials, combinations thereof and the like.

The tip member (615) is detachably connected to the second end (565) of the second pull bar (550). The tip member (615) positioned substantially perpendicular to the position of the second end (565) of the second pull bar (550). In use, the tip member (615) pushes upward on the dent to "push" the dent out from below the surface of the vehicle. The tip member (615) may be constructed from any material sufficiently rigid to maintain the structural integrity of the paintless dent removal tool (500) when in use. For example, the tip member (615) may be constructed from metals, alloys, steel, titanium, non-metals, carbon fiber, plastics, polymers, resins, ceramics, composite materials, combinations thereof and the like. The tip member (615) may have any desired shape, including but not limited to, a generally curved, straight, circular, square, triangular or any other desired shape sufficient to permit the paintless dent removal tool (500) to be used as described and claimed herein.

Figure 6:
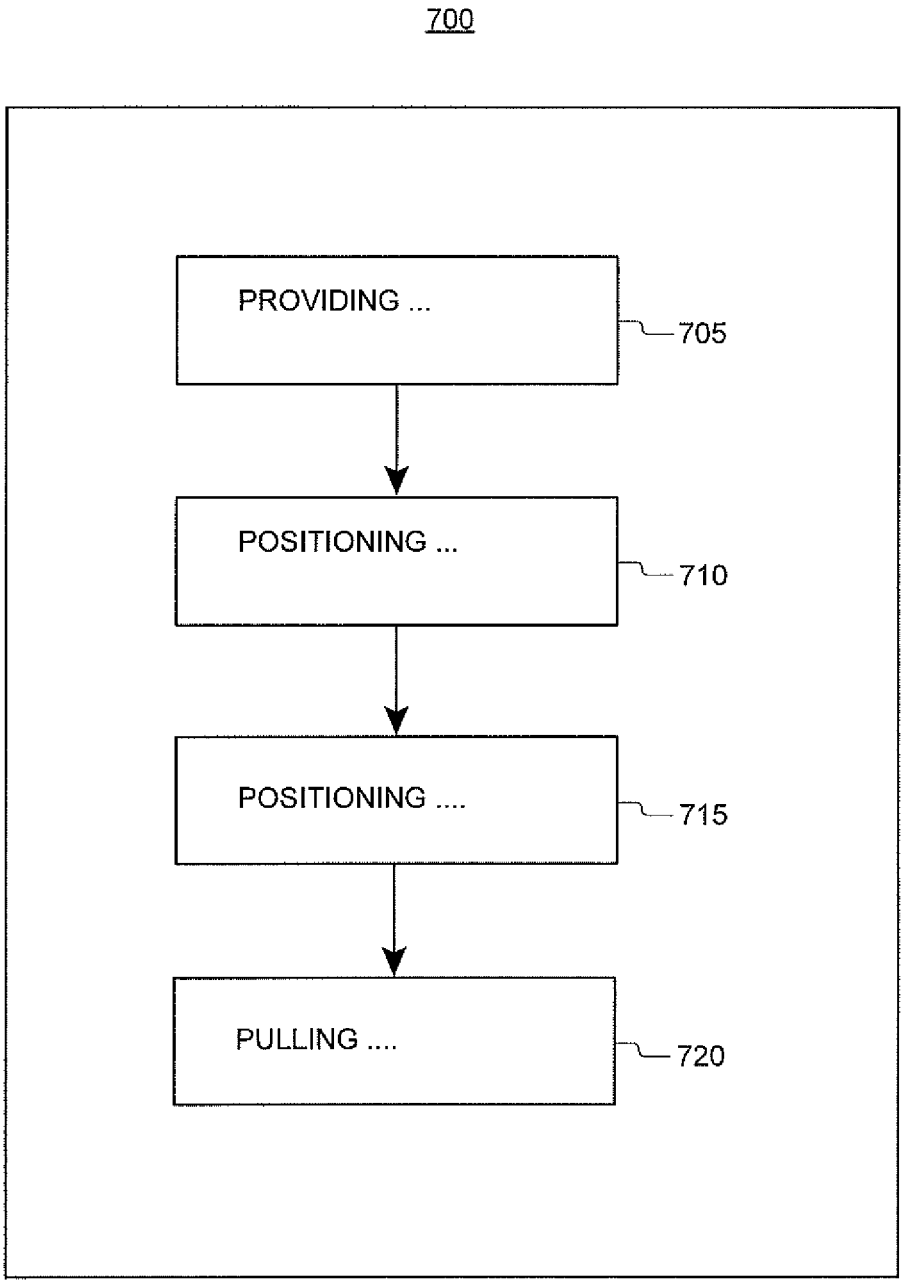
FIG. 6 is a diagram of a method (700) of removing a dent from a vehicle, according to the inventive concepts disclosed herein.

Referring now to FIG. 6, shown therein is a method (700) of removing a dent from a vehicle. The method (700) including the step of providing (705) the paintless dent removal tool (500). The paintless dent removal tool (500) includes a stabilizer assembly (505) having a first leg (510), a second leg (515) and a body (520) therebetween. The stabilizer assembly (505) is for stabilizing the paintless dent removal tool (500) on a surface of a vehicle. The paintless dent removal tool (500) includes a first pull bar (530) having a first end (535), a middle portion (540) and a second end (545). The first end (535) of the first pull bar (530) is adjustably connected to the body (520) of the stabilizer assembly (505). The paintless dent removal tool (500) includes a second pull bar (550) having a first end (555), a middle portion (560) and a second end (565). The middle portion (560) of the second pull bar (550) is adjustably connected to the first pull bar (530). The paintless dent removal tool (500) includes a lever assembly (570) having a rod (575), a connector (580), a clamp (585) and a handle (590). The rod (575) is positioned substantially perpendicular to the first pull bar (530) and the second pull bar (550). The rod (575) has a first end (600) detachably connected to the second pull bar (550) and a second end (605) detachably connected to the connector (580). The connector (580) is detachably connected to the rod (575) and the clamp (585). The clamp (585) is slide-ably mounted on the first pull bar (530) between the first end (535) and the second end (545) of the first pull bar (530). The handle (590) is detachably connected to the clamp (585). The paintless dent removal tool (500) includes a tip member (615) that is detachably connected to the second end (565) of the second pull bar (550). The tip member (615) is positioned substantially perpendicular to the position of the second end (565) of the second pull bar (550). The method (700) of removing a dent from a vehicle further includes the step of positioning (710) the stabilizer assembly (505) on the surface of the vehicle. The first leg (510) of the stabilizer assembly (505) and the second leg (515) of the stabilizer assembly (505) are positioned between the dent on the surface of the vehicle. The method (700) of removing a dent from a vehicle further includes the step of positioning (715) the tip member (615) below the surface of the vehicle. The tip member (615) is positioned below the dent and is positioned between the first leg (510) and the second leg (515) of the stabilizer assembly (505). The method (700) of removing a dent from a vehicle includes the step of pulling (720) the handle (590) of the lever assembly (570) upward by a user, so that the tip member (615) moves upward between the first leg (510) and the second leg (515) of the stabilizer assembly (505) to push a dent out from underneath the surface of the vehicle.

It is to be appreciated that embodiments of the inventive concepts disclosed herein may be shipped fully or partially assembled, or fully or partially disassembled in the form of a kit, as will be readily appreciated by persons of ordinary skill in the art having the benefit of the instant disclosure.

From the above description, it is clear that the inventive concepts disclosed herein are adapted to carry out the objects and to attain the advantages mentioned herein as well as those inherent in the inventive concepts disclosed herein. While exemplary embodiments of the inventive concepts disclosed herein have been described for purposes of this disclosure, it will be understood that numerous changes may be made which will readily suggest themselves to those skilled in the art and which are accomplished within the broad scope of the inventive concepts disclosed herein and defined by the appended claims.

What is claimed is:

1. A paintless dent removal tool for removing a dent from a vehicle, the paintless dent removal tool comprising:

a stabilizer assembly having a first leg, a second leg and a body therebetween, the body having an opening therethrough, the stabilizer assembly for stabilizing the paintless dent removal tool on a surface of a vehicle;

a pull bar having a first end and a second end, the first end of the pull bar positioned partially through the opening of the body of the stabilizer assembly and adjustably connected thereto;

a handle assembly having a first end, a middle portion and a second end, the middle portion of the handle assembly adjustably connected to the second end of the pull bar; and a tip member detachably connected to the second end of the handle assembly, the tip member positioned substantially perpendicular to the position of the second end of the handle assembly;

wherein the first end of the handle assembly is configured to be pulled upward by a user so that the tip member moves upward between the first leg and the second leg of the stabilizer assembly to push a dent out from underneath the surface of the vehicle.

2. The paintless dent removal tool of claim 1, wherein the stabilizer assembly is substantially Y-shaped.

3. The paintless dent removal tool of claim 1, wherein the pull bar is substantially L-shaped.

4. The paintless dent removal tool of claim 1, wherein the handle assembly is substantially U-shaped.

5. A method of removing a dent from a vehicle, the method comprising the steps of:

providing a paintless dent removal tool for removing a dent from a vehicle, the paintless dent removal tool comprising:

a stabilizer assembly having a first leg, a second leg and a body therebetween, the body having an opening therethrough, the stabilizer assembly for stabilizing the paintless dent removal tool on a surface of a vehicle;

a pull bar having a first end and a second end, the first end of the pull bar positioned partially through the opening of the body of the stabilizer assembly and adjustably connected thereto;

a handle assembly having a first end, a middle portion and a second end, the middle portion of the handle assembly adjustably connected to the second end of the pull bar; and a tip member detachably connected to the second end of the handle assembly, the tip member positioned substantially perpendicular to the position of the second end of the handle assembly;

positioning the stabilizer assembly on the surface of the vehicle, the first leg of the stabilizer assembly and the second leg of the stabilizer assembly positioned between the dent on the surface of the vehicle;

positioning the tip member below the surface of the vehicle, the tip member positioned below the dent and positioned between the first leg and the second leg of the stabilizer assembly; and pulling the handle assembly upward by a user, so that the tip member moves upward between the first leg and the second leg of the stabilizer assembly to push a dent out from underneath the surface of the vehicle.

6. A paintless dent removal tool for removing a dent from a vehicle, the paintless dent removal tool comprising:

a stabilizer assembly having a first leg, a second leg and a body therebetween, the stabilizer assembly for stabilizing the paintless dent removal tool on a surface of a vehicle;

a first pull bar having a first end, a middle portion and a second end, the first end of the first pull bar adjustably connected to the body of the stabilizer assembly;

a second pull bar having a first end, a middle portion and a second end, the middle portion of the second pull bar adjustably connected to the first pull bar;

a lever assembly having a rod, a connector, a clamp and a handle, the rod positioned substantially perpendicular to the first pull bar and the second pull bar and having a first end detachably connected to the second pull bar and a second end detachably connected to the connector, the connector detachably connected to the rod and the clamp, the clamp slide-ably mounted on the first pull bar between the first end and the second end of the first pull bar, the handle detachably connected to the clamp; and a tip member detachably connected to the second end of the second pull bar, the tip member positioned substantially perpendicular to the position of the second end of the second pull bar;

wherein the handle of the lever assembly is configured to be pulled upward by a user so that the tip member moves upward between the first leg and the second leg of the stabilizer assembly to push a dent out from underneath the surface of the vehicle.

7. The paintless dent removal tool of claim 6, wherein the stabilizer assembly is substantially Y-shaped.

8. The paintless dent removal tool of claim 6, wherein the first pull bar is substantially L-shaped.

9. The paintless dent removal tool of claim 6, wherein the second pull bar is substantially U-shaped.

10. A method of removing a dent from a vehicle, the method comprising the steps of:

providing the paintless dent removal tool comprising:

a stabilizer assembly having a first leg, a second leg and a body therebetween, the stabilizer assembly for stabilizing the paintless dent removal tool on a surface of a vehicle;

a first pull bar having a first end, a middle portion and a second end, the first end of the first pull bar adjustably connected to the body of the stabilizer assembly;

a second pull bar having a first end, a middle portion and a second end, the middle portion of the second pull bar adjustably connected to the first pull bar;

a lever assembly having a rod, a connector, a clamp and a handle, the rod positioned substantially perpendicular to the first pull bar and the second pull bar and having a first end detachably connected to the second pull bar and a second end detachably connected to the connector, the connector detachably connected to the rod and the clamp, the clamp slide-ably mounted on the first pull bar between the first end and the second end of the first pull bar, the handle detachably connected to the clamp; and a tip member detachably connected to the second end of the second pull bar, the tip member positioned substantially perpendicular to the position of the second end of the second pull bar;

positioning the stabilizer assembly on the surface of the vehicle, the first leg of the stabilizer assembly and the second leg of the stabilizer assembly positioned between the dent on the surface of the vehicle;

positioning the tip member below the surface of the vehicle, the tip member positioned below the dent and positioned between the first leg and the second leg of the stabilizer assembly; and pulling the handle of the lever assembly upward by a user, so that the tip member moves upward between the first leg and the second leg of the stabilizer assembly to push a dent out from underneath the surface of the vehicle.

* * * * *